US011976899B1

(12) United States Patent
Skelton et al.

(10) Patent No.: US 11,976,899 B1
(45) Date of Patent: May 7, 2024

(54) FAST MOUNTING DEVICE FOR MULTIPLE SLOT INTERFACE

(71) Applicant: Sarissa Innovations LLC, Wilmington, DE (US)

(72) Inventors: Tyler Skelton, Missouri City, TX (US); Joseph Gaddini, Wilmington, NC (US)

(73) Assignee: SARISSA INNOVATIONS LLC, Wilmington, DE (US)

( * ) Notice: Subject to any disclaimer, the term of this patent is extended or adjusted under 35 U.S.C. 154(b) by 0 days.

(21) Appl. No.: 18/098,454

(22) Filed: Jan. 18, 2023

Related U.S. Application Data

(60) Provisional application No. 63/361,717, filed on Jan. 18, 2022.

(51) Int. Cl.
*F41C 27/00* (2006.01)
*F41G 11/00* (2006.01)

(52) U.S. Cl.
CPC ..... *F41C 27/00* (2013.01); *F41G 11/003* (2013.01)

(58) Field of Classification Search
CPC ..... F41C 27/00; F41G 11/003
USPC ..... 42/90
See application file for complete search history.

(56) References Cited

U.S. PATENT DOCUMENTS 8,341,866 B1 * 1/2013 Gaddini ..... F41C 23/04 42/71.01
8,898,948 B1 * 12/2014 Gaddini ..... F41C 23/16 42/71.01
9,777,985 B2 * 10/2017 Roberts ..... F41C 27/00
10,024,632 B1 * 7/2018 Oglesby ..... F41G 11/003
10,101,126 B2 10/2018 Sharron
10,371,482 B2 8/2019 Roberts
10,393,481 B2 8/2019 Langevin
10,907,937 B1 * 2/2021 Keng ..... F41G 11/003
11,150,055 B2 10/2021 Gehring
D940,813 S 1/2022 Weigand
D954,169 S 6/2022 Zimmer
2015/0285583 A1 * 10/2015 Mayberry ..... F41A 23/08 42/71.01
2015/0285584 A1 * 10/2015 Mayberry ..... F41G 11/004 42/71.01
2016/0209175 A1 7/2016 Sharron
2017/0067720 A1 * 3/2017 Visinski ..... F41G 11/003
2021/0293512 A1 * 9/2021 Duncan, III ..... F41G 11/003
(Continued)

OTHER PUBLICATIONS

Kinetic Development Group, Kinect—3 Slot Picatinny, retrieved on Jan. 17, 2023, https://kineticdg.com/product/kinectmlok-3-slot-single-mlok-picatinny-section/, 4 pages.

*Primary Examiner* — Samir Abdosh
(74) *Attorney, Agent, or Firm* — Brian S. Steinberger; Hilary F. Steinberger; Law Offices of Brian S. Steinberger, P.A.

(57) ABSTRACT

Devices, assemblies, systems, and methods for providing a quick and easy accessory mounting device for mounting to a multiple slot interface, such as a multiple slot rail on a firearm. The mounting device/assembly allows for firearm accessories such as foregrips, bipods, scopes lights, bayonets, and the like, can be easily interchangeably attached to the multiple slot interface on the firearm. A wedge member having two wedge legs can be activated to move below the device/assembly and attach to a pair of slots in the multiple slot rail on the firearm. A torque screw can be also used to lock the wedge legs in place.

19 Claims, 19 Drawing Sheets

(56) References Cited

U.S. PATENT DOCUMENTS

| | | | | |
|---|---|---|---|---|
| 2021/0325144 | A1* | 10/2021 | Kincel | F41C 27/00 |
| 2022/0003393 | A1* | 1/2022 | Starr | F21V 23/04 |
| 2022/0214142 | A1* | 7/2022 | Ding | F41G 11/004 |
| 2023/0003486 | A1* | 1/2023 | Johnson, Sr. | F41G 11/003 |
| 2023/0272811 | A1* | 8/2023 | Stabler | F16B 2/185<br>248/205.1 |
| 2023/0296353 | A1* | 9/2023 | Portoghese | F41C 23/16<br>434/19 |

* cited by examiner

FIG. 7A1
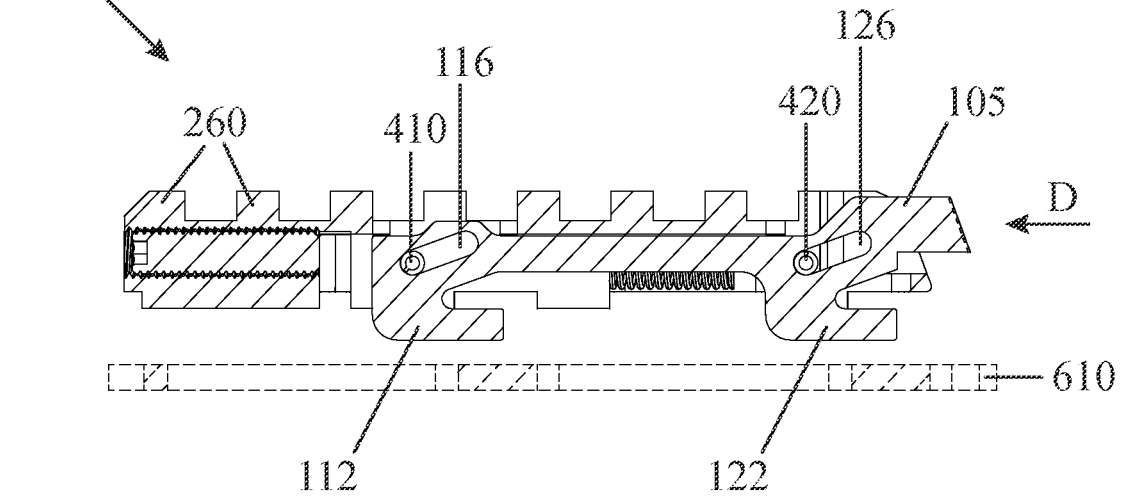
FIG. 7B1
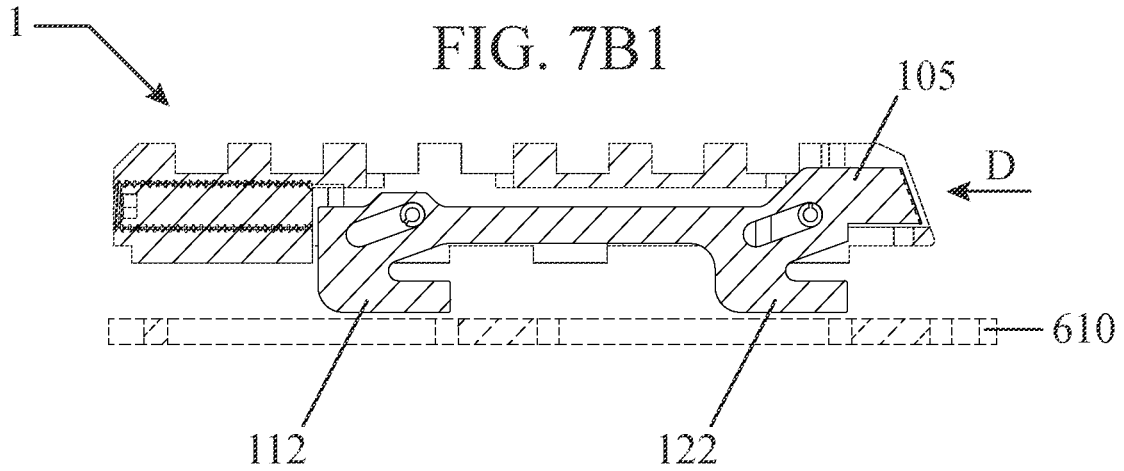
FIG. 7C1
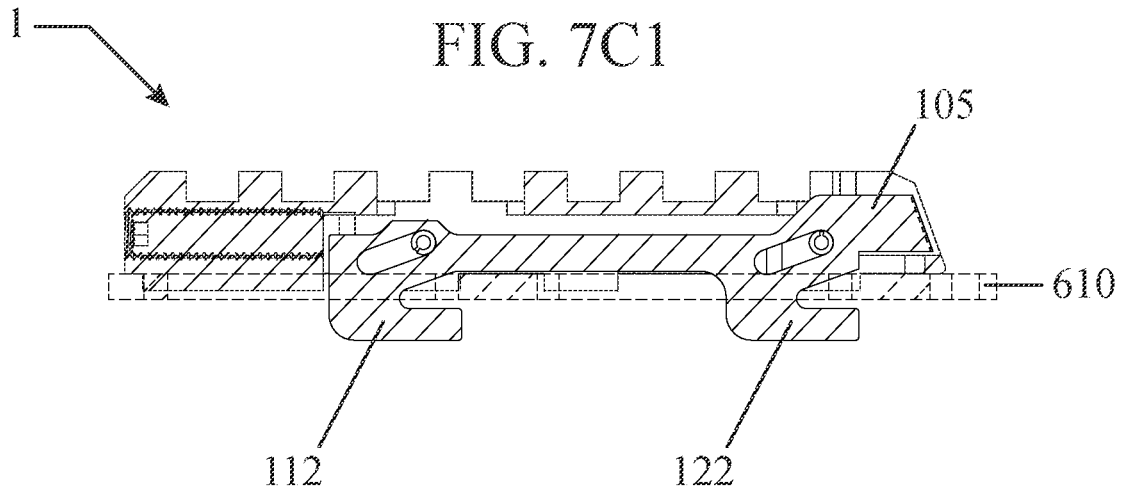

FIG. 7D1
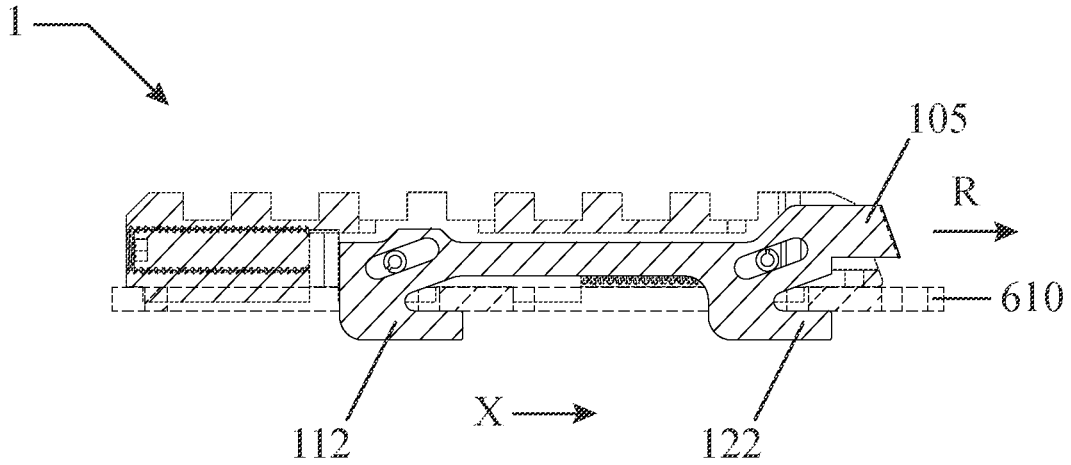
FIG. 7E1
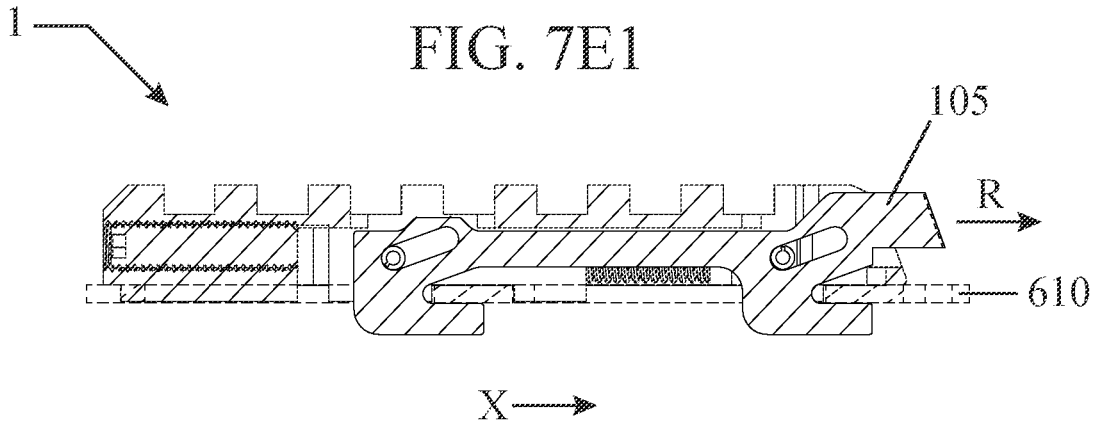
FIG. 7F1
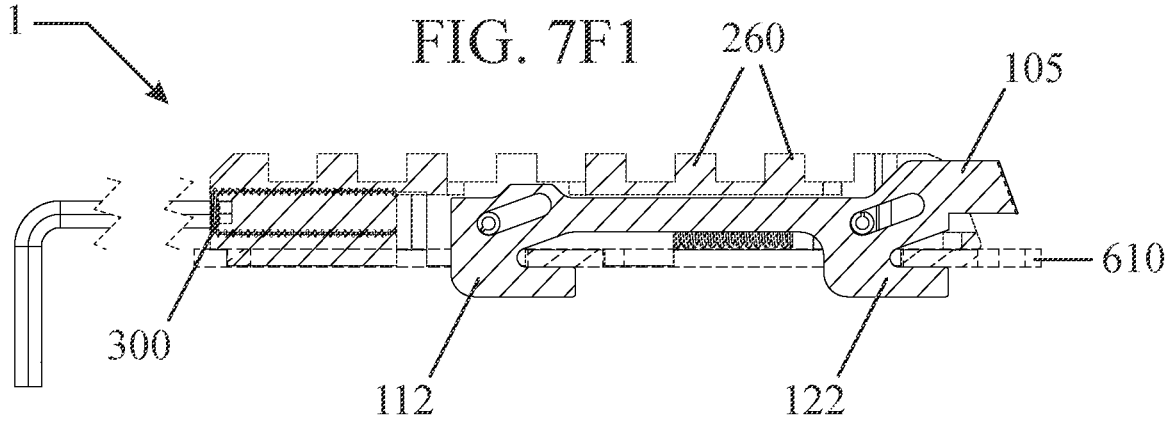

FIG. 7A2
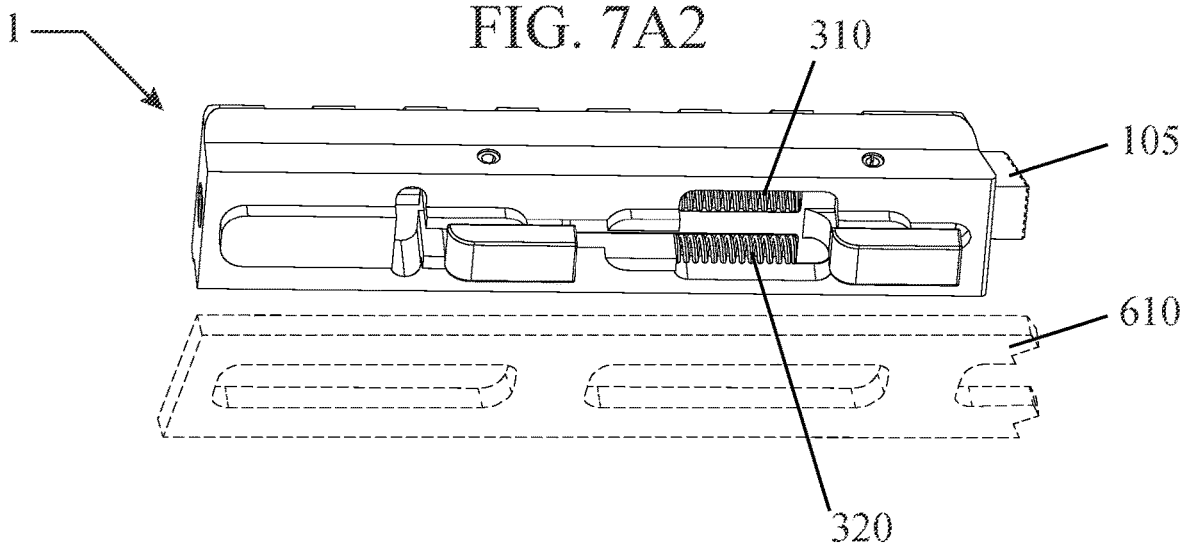
FIG. 7B2
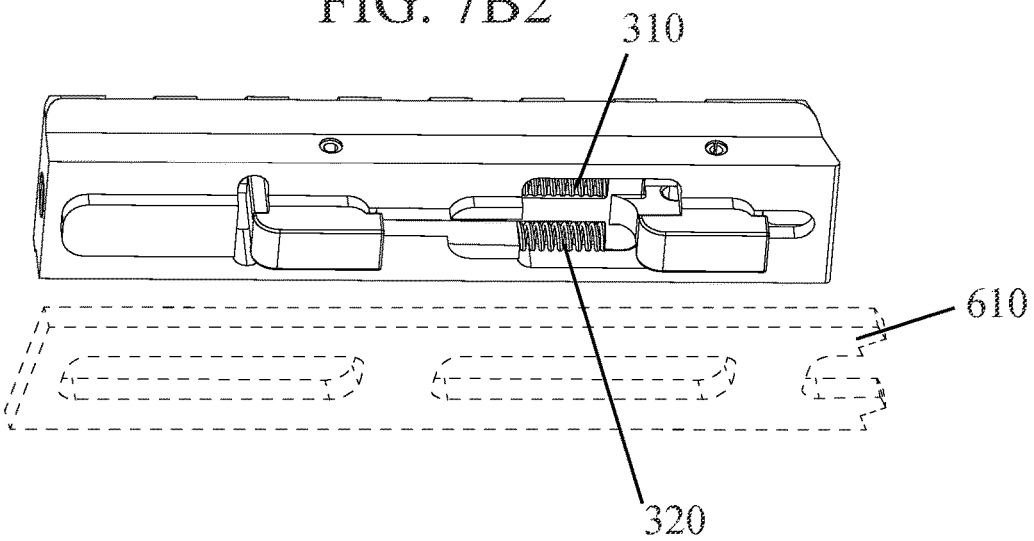
FIG. 7C2
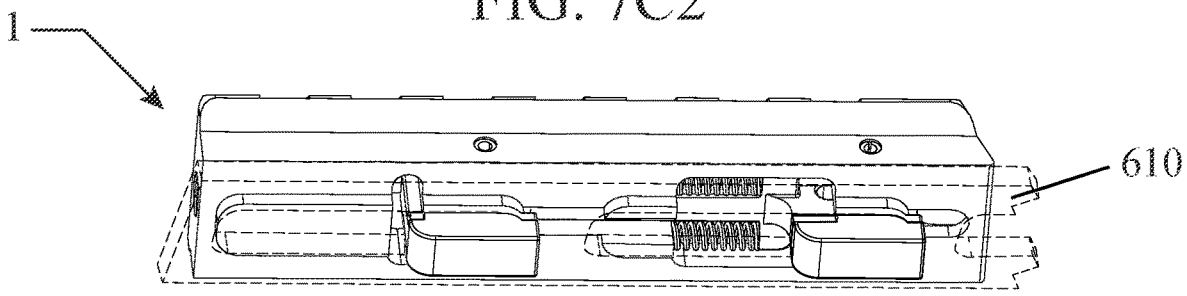

FIG. 7D2
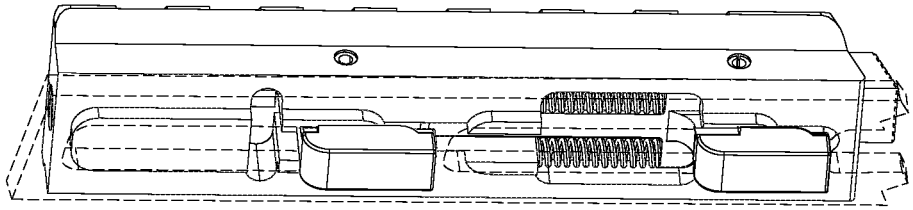
FIG. 7E2
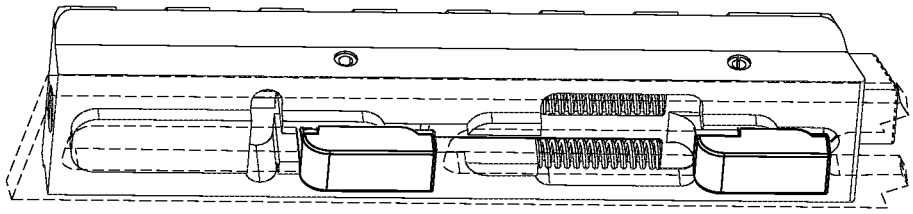
FIG. 7F2
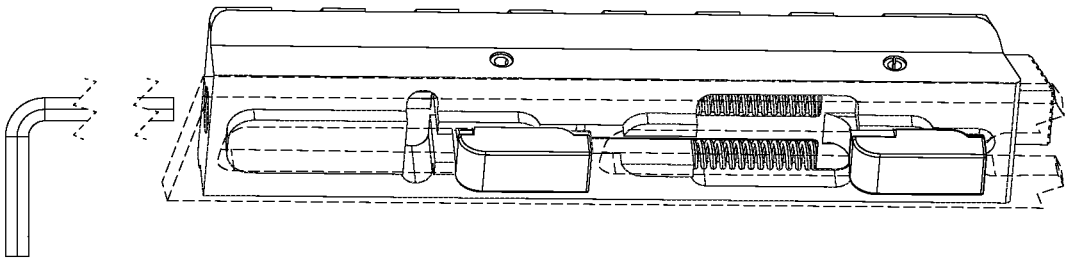

FIG. 7A3
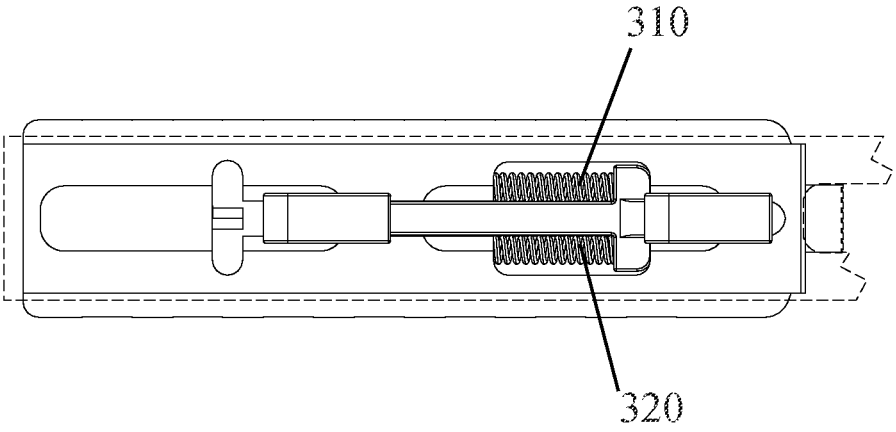
FIG. 7B3
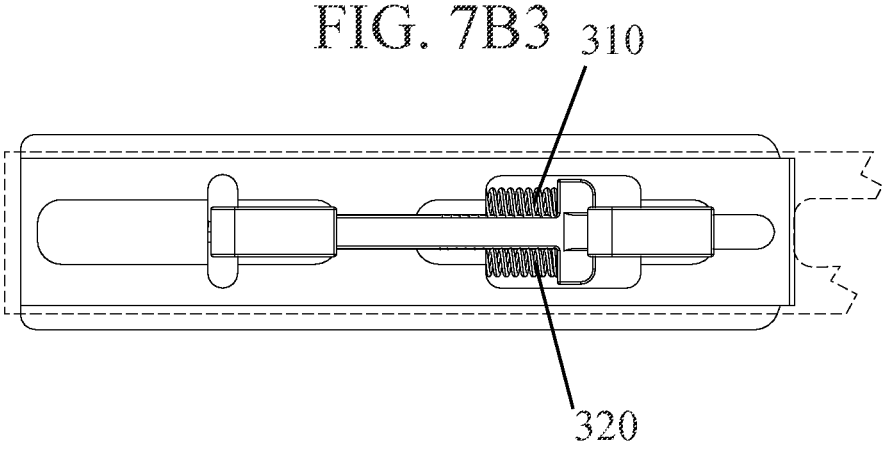
FIG. 7C3
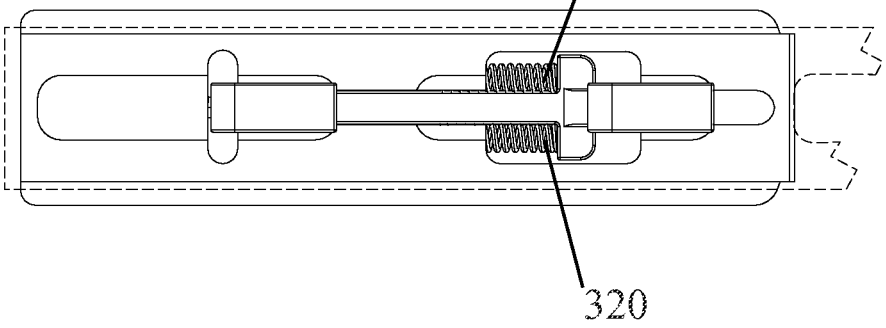

FIG. 7D3
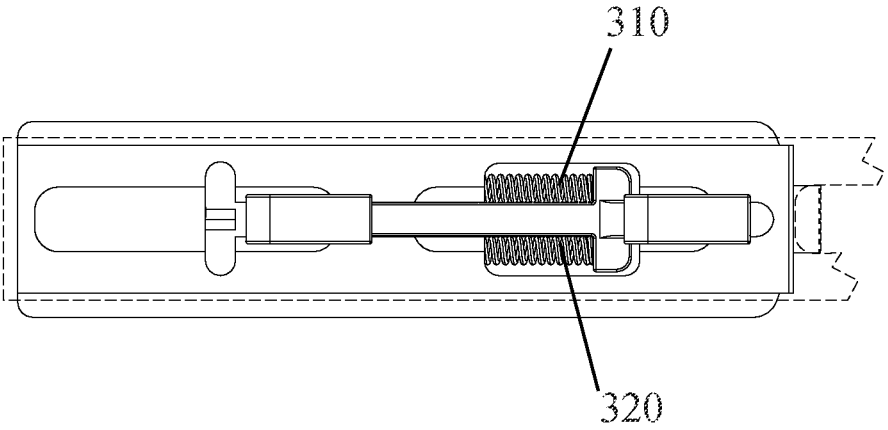
FIG. 7E3
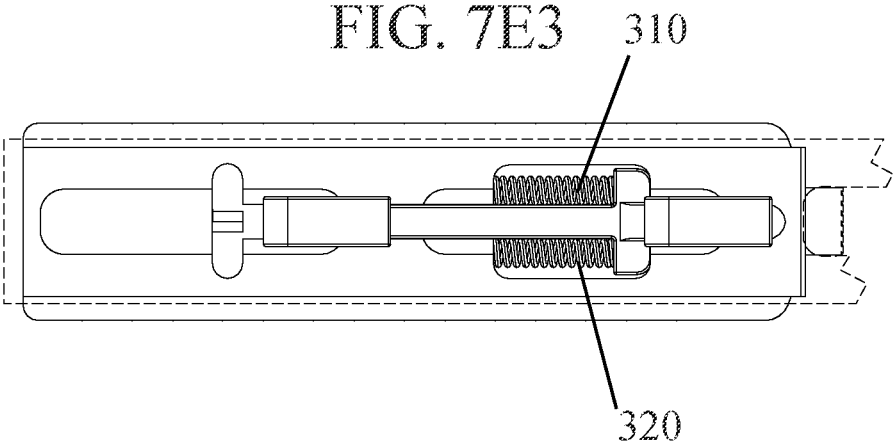
FIG. 7F3
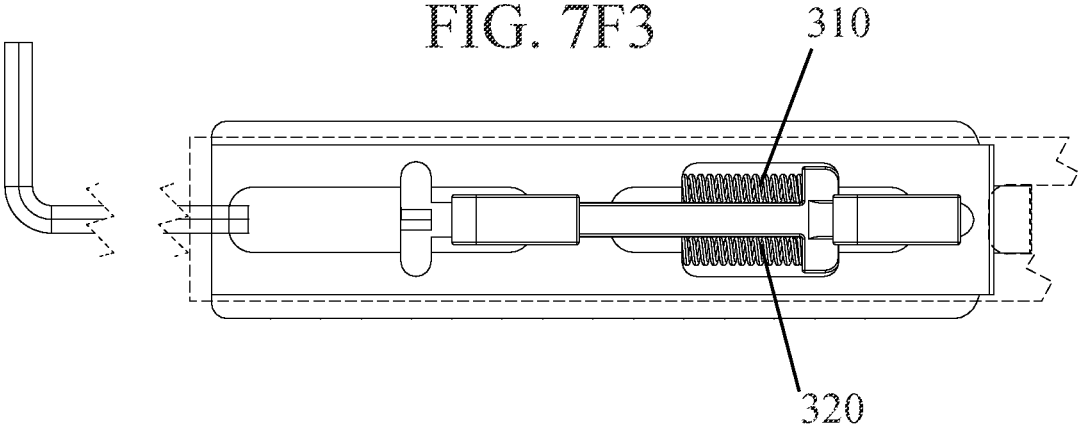

FAST MOUNTING DEVICE FOR MULTIPLE SLOT INTERFACE

CROSS REFERENCE TO RELATED APPLICATIONS

This application claims the benefit of priority to U.S. Provisional Application Ser. No. 63/361,717 filed Jan. 18, 2022, which is incorporated herein by reference thereto.

FIELD OF INVENTION

This invention relates to firearm accessory mounting devices, and in particular to devices, assemblies, systems, and methods for providing a quick and easy accessory mounting device for mounting to a multiple slot rail on a firearm, so that firearm accessories such as foregrips, bipods, scopes lights, bayonets, and the like, can be easily interchangeably attached to the multiple slot rail on the firearm.

BACKGROUND AND PRIOR ART

M-LOK™ is a firearm rail interface system developed by Magpul Industries of Austin Texas, allows for direct accessory attachment on hollow slot mounting locations. The multiple slots can be parallel rows of longitudinal oval shaped slots See for example FIGS. 6-19 of U.S. Pat. No. 10,393,481 to Langevin et al., which is incorporated by reference in its' entirety. The M-LOK™ provides a standard mounting platform for different accessory attachments, such as scopes, lights and the like.

However, attaching accessories has required the use of extra tools, that can be difficult to use, and time consuming, which is not desirable in when needed to be used in military and law enforcement applications.

Various types of mounting devices have been proposed over the years to work with the M-LOK™ multiple slot rails. See for example, U.S. Pat. No. 10,101,126 to Sharron et al., which is incorporated by reference in its' entirety.

However, this device can fail under firearm recoil conditions, where the device can easily get dislodged over time when the firearm is used.

Thus, the need exists for solutions to the above problems with the prior art.

SUMMARY OF THE INVENTION

A primary objective of the present invention is to provide a quick and easy mounting devices, assemblies, systems, and methods for providing a quick and easy accessory mounting device for mounting to a multiple slot rail on a firearm, so that firearm accessories such as foregrips, bipods, scopes lights, bayonets, and the like, can be easily interchangeably attached to the multiple slot rail on the firearm.

A secondary objective of the present invention is to provide a quick and easy mounting devices, assemblies, systems, and methods for providing a quick and easy accessory mounting device for mounting to a multiple slot rail on a firearm having different thickness rail surfaces, so that firearm accessories such as foregrips, bipods, scopes lights, bayonets, and the like, can be easily interchangeably attached to the multiple slot rail on the firearm.

A third objective of the present invention is to provide a quick and easy mounting devices, assemblies, systems, and methods for providing a quick and easy accessory mounting device for mounting to a multiple slot rail on a firearm, which can be locked into position, and does not become dislodged from reoil effects of using the firearm, so that firearm accessories such as foregrips, bipods, scopes lights, bayonets, and the like, can be easily interchangeably attached to the multiple slot rail on the firearm.

A preferred embodiment of the mounting assembly includes a double wedge member which attaches to a base mount with picatinny rails.

The device can attach to a multiple slot rail platform system faster and easier than existing products.

The device includes a double wedge that rides on two pins, with two grooves of an acute angle that allow movement until the wedge surfaces become parallel to the inside surface.

This deviation is necessary because of the various thicknesses of rails and mounting surfaces.

A first embodiment of mounting this device includes a quick release, that has camming wedges, with mounted springs.

A second embodiment uses a torque screw which locks the wedges in place.

The device and be used for rails, grips, flashlight adapters, and various other products that can be mounted and used on a multiple slot rail.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

Sequence Views 7A1-7F1

FIG. 7A1 is a side cross-sectional view of the assembled mounting device detached from a multiple slot rail (mounting interface) on a firearm.

FIG. 7B1 shows the mounting device of FIG. 7A1 with push button depressed causing the two wedge legs to extend below the assembly, ready to be positioned into a pair of slots on the rail.

FIG. 7C1 shows the mounting device of FIG. 7B1 sitting flush on the mounting interface of the rail with the wedge legs within the two slots (with button still depressed).

FIG. 7D1 shows the mounting device of FIG. 7C1 with the wedge legs moving in the direction of arrow X to locked positions, as the button is being released.

FIG. 7E1 shows the mounting device of FIG. 7C1 with a thinner wall thickness on the multiple slot rail (mounting interface) on a firearm, with the wedge legs moving in the direction of arrow X to locked positions, as the button is being released.

FIG. 7F1 is another view of FIGS. 7D1 and 7E1, using a secondary locking feature with the rear screw torqued down to prevent the wedge legs from moving out of their locked positions.

FIG. 7A2 is a lower side perspective view of FIG. 7A1.

FIG. 7B2 is a lower side perspective view of FIG. 7B1.

FIG. 7C2 is a lower side perspective view of FIG. 7C1.

FIG. 7D2 is a lower side perspective view of FIG. 7D1.

FIG. 7E2 is a lower side perspective view of FIG. 7E1.

FIG. 7F2 is a lower side perspective view of FIG. 7F1.

FIG. 7A3 is a is a bottom view of FIG. 7A1.

FIG. 7B3 is a bottom view of FIG. 7B1.

FIG. 7C3 is a bottom view of FIG. 7C1.

FIG. 7D3 is a bottom view of FIG. 7D1.

FIG. 7E3 is a bottom view of FIG. 7E1.

FIG. 7F3 is a bottom view of FIG. 7F1.

Figure 8:
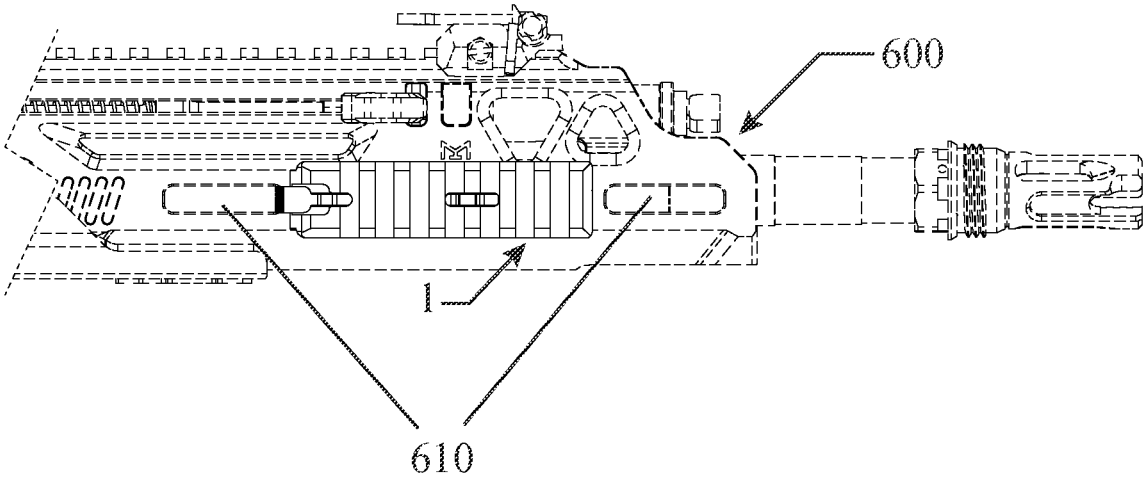

FIG. 8 is a perspective view of the assembled mounting device locked on a multiple slot rail (mounting interface) on a firearm.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figure 1A:
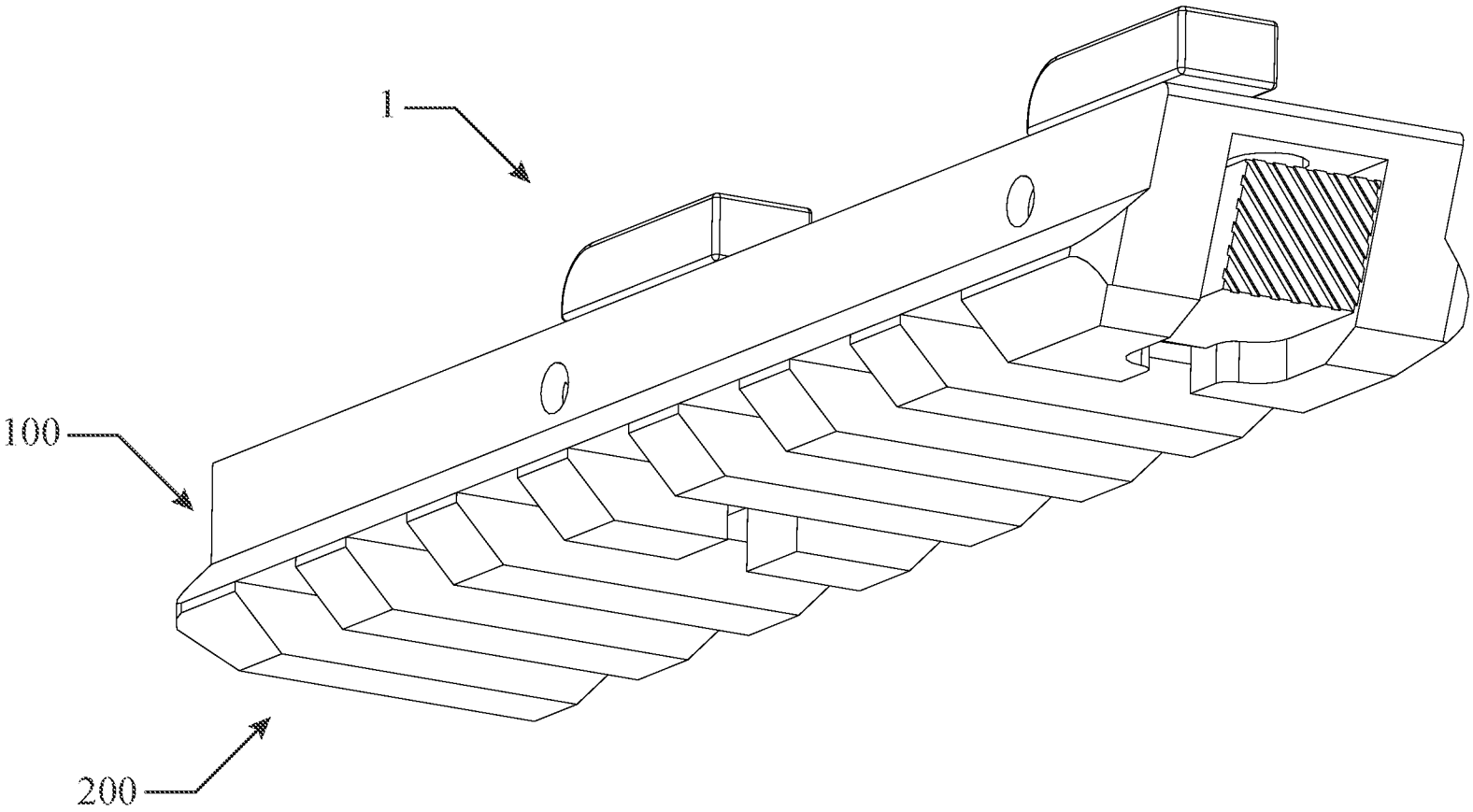
FIG. 1A is a lower rear perspective view of the assembled mounting device.
Figure 1B:
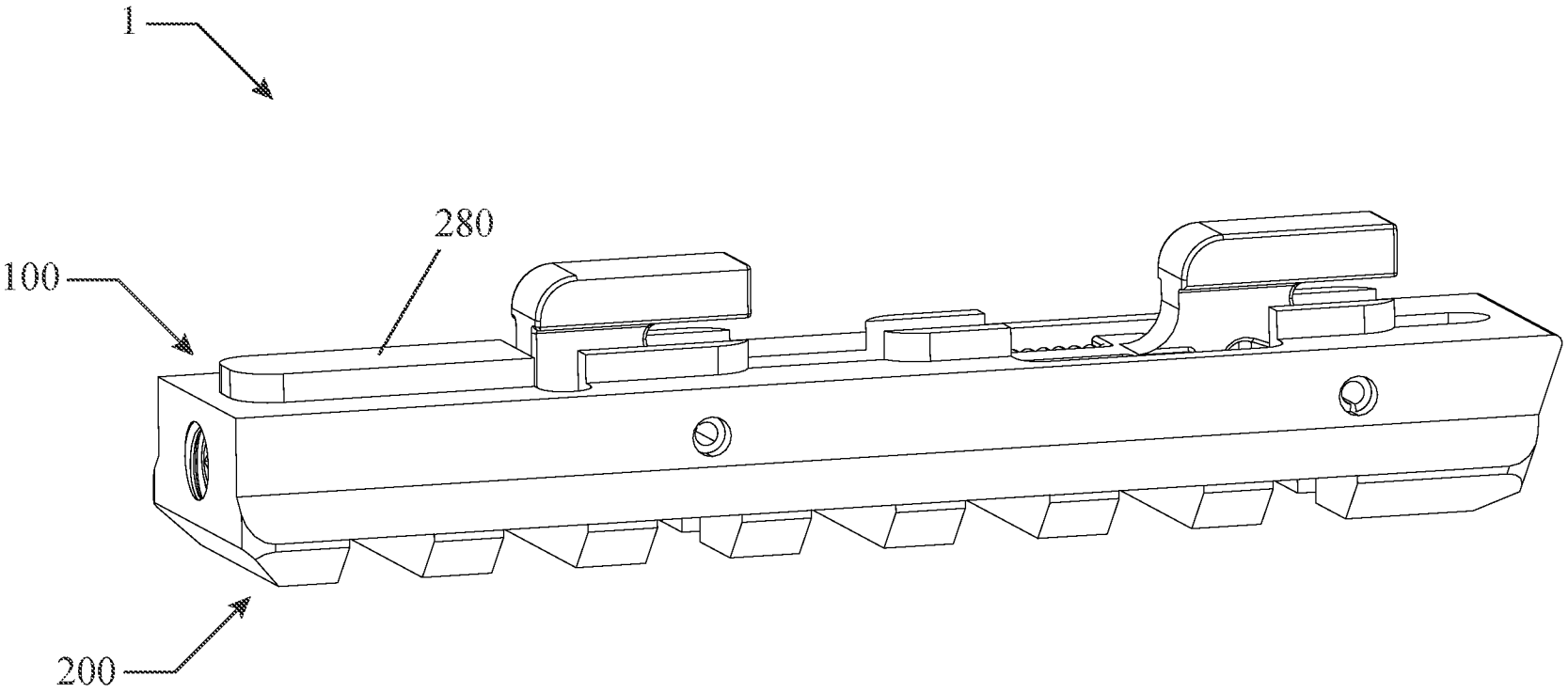
FIG. 1B is an upper front perspective view of the mounting device of FIG. 1A.

1 Assembled device
100 double wedge member
105 knurled side (button surface)
108 long beam
110 first wedge
112 first wedge leg (first locking lug)
113 flat overhang horizontal surface on first leg
114 first wedge space
116 first angled elliptical slot leg (
120 second wedge
122 second wedge leg (second locking lug)
123 flat overhang horizontal surface on second leg
124 second wedge space
126 second angled elliptical slot
130 first side stem for first coil spring 310
140 second side stem for second coil spring 320
200 picatinny base mount
205 cavity for button 105
210 first through-hole for first pin spring 410
220 second through-hole for second pin spring 420
230 front end threaded socket for torque screw 500
240 longitudinal cavity in top of base mount
260 picatinny rails
280 raised boss(es)
310 first horizontal coil spring
320 second horizontal coil spring
410 first pin spring, cylinder with side slit
420 second pin spring, cylinder with side slit
500 torque screw
600 firearm
610 multiple slot rail platform/interface
610' thinner wall on mounting platform/interface FIG. 1A is a lower rear perspective view of the assembled mounting device 1. FIG. 1B is an upper front perspective view of the assembled mounting device 1 of FIG. 1A.

Figure 1C:
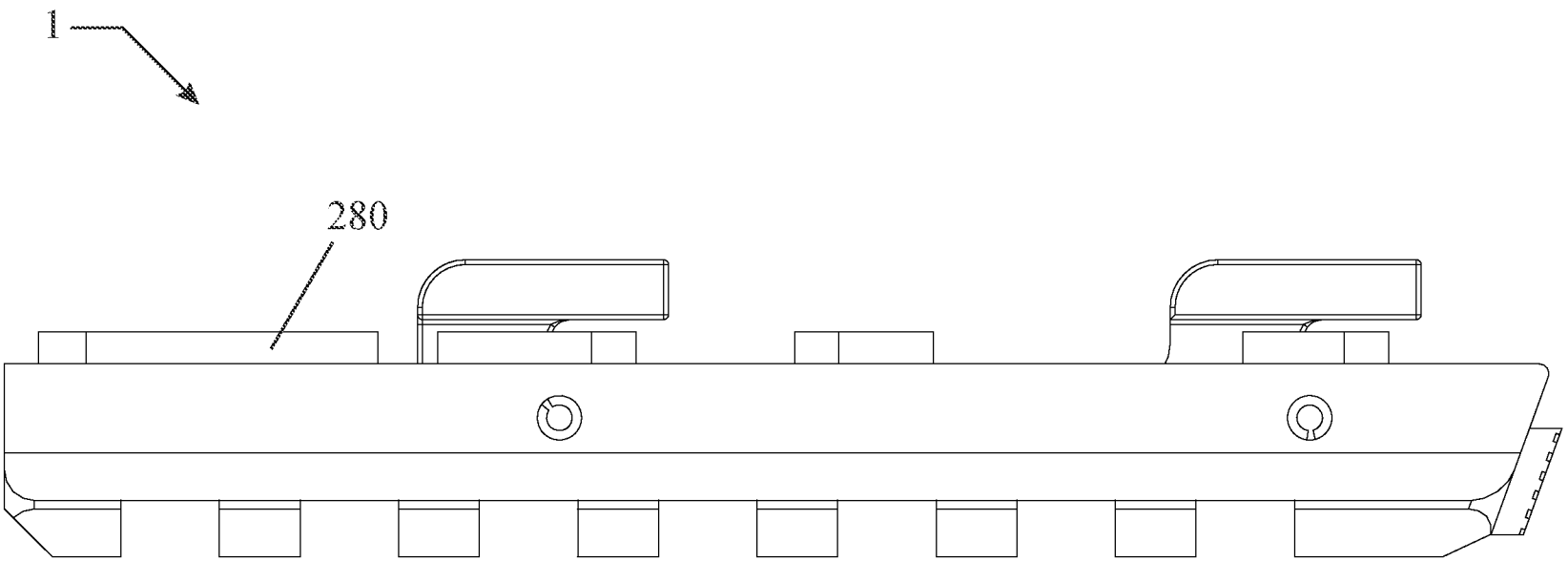
FIG. 1C is side view of the mounting device of FIG. 1A.
Figure 1D:
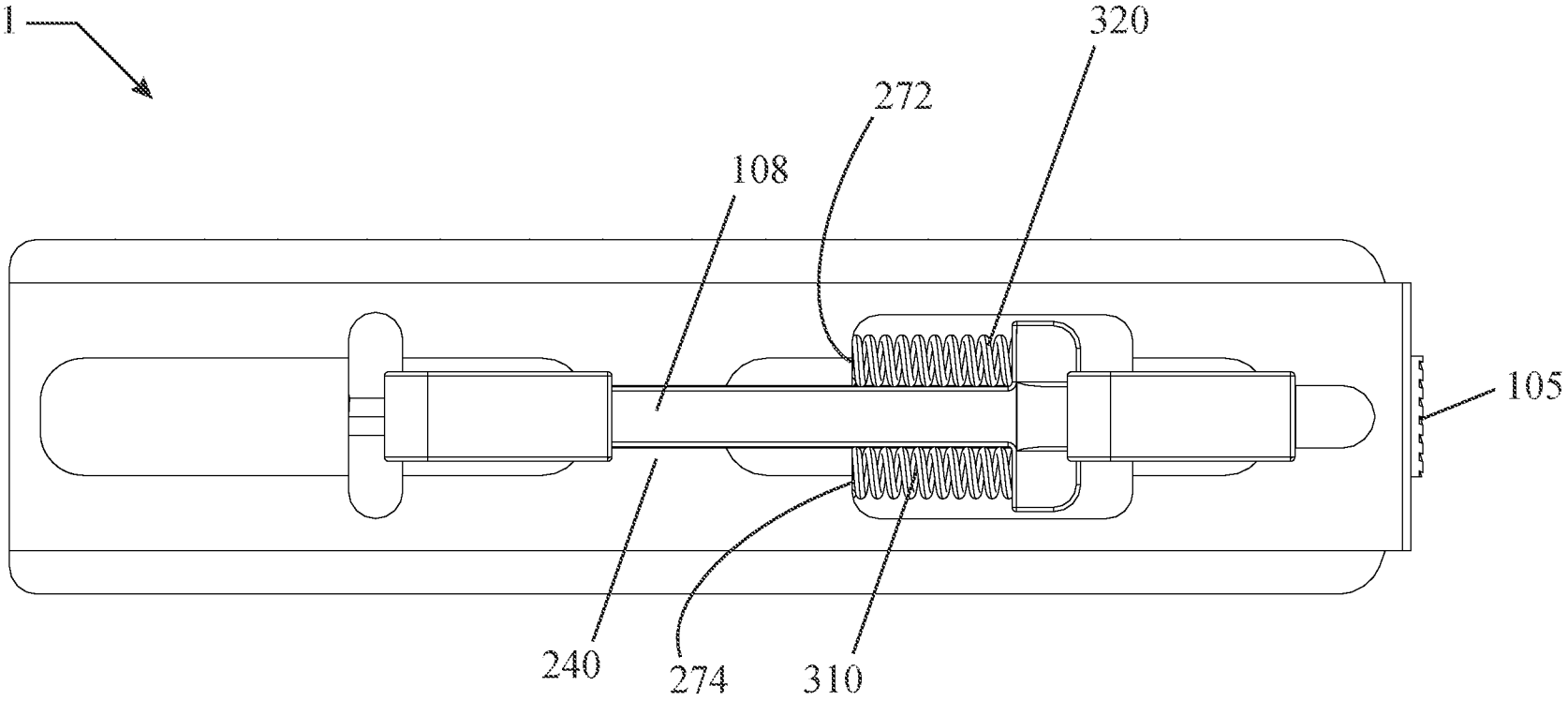
FIG. 1D is top view of the mounting device of FIG. 1A.
Figure 1E:
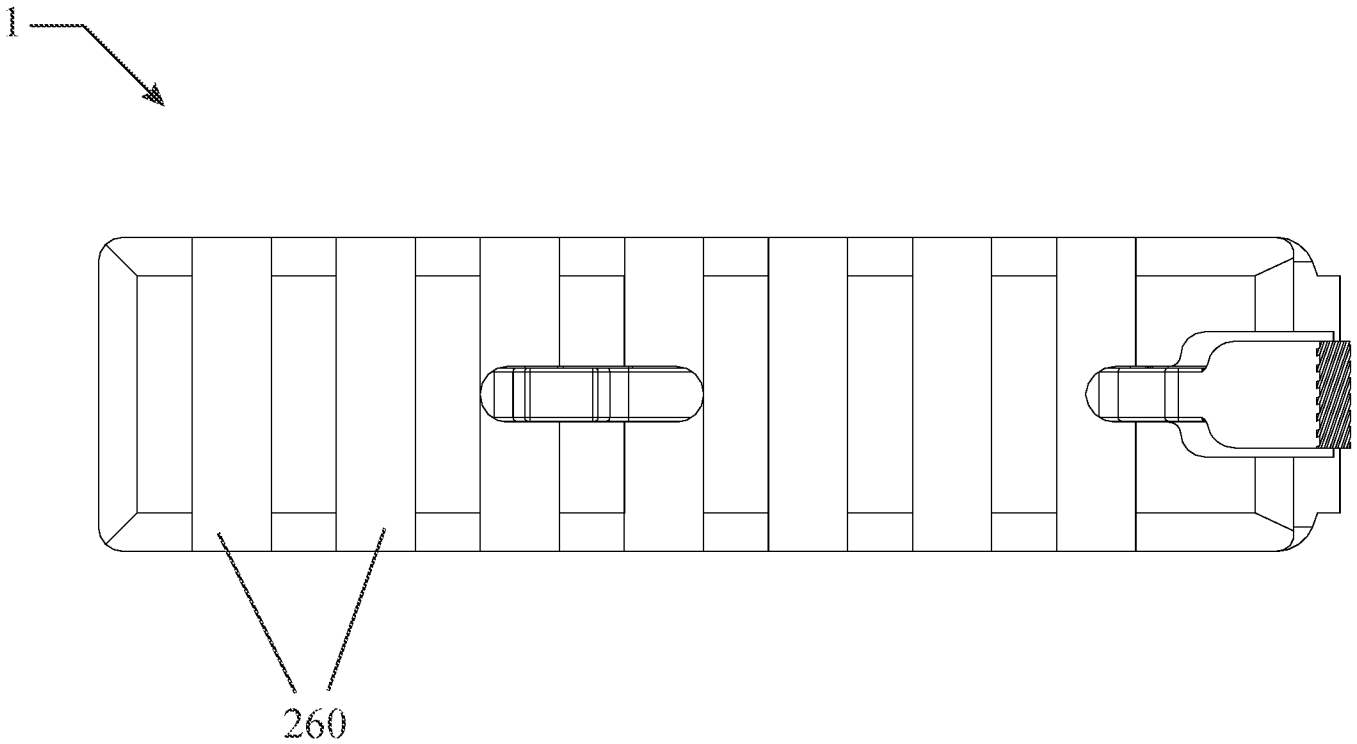
FIG. 1E is a bottom view of the mounting device of FIG. 1A.
Figure 1F:
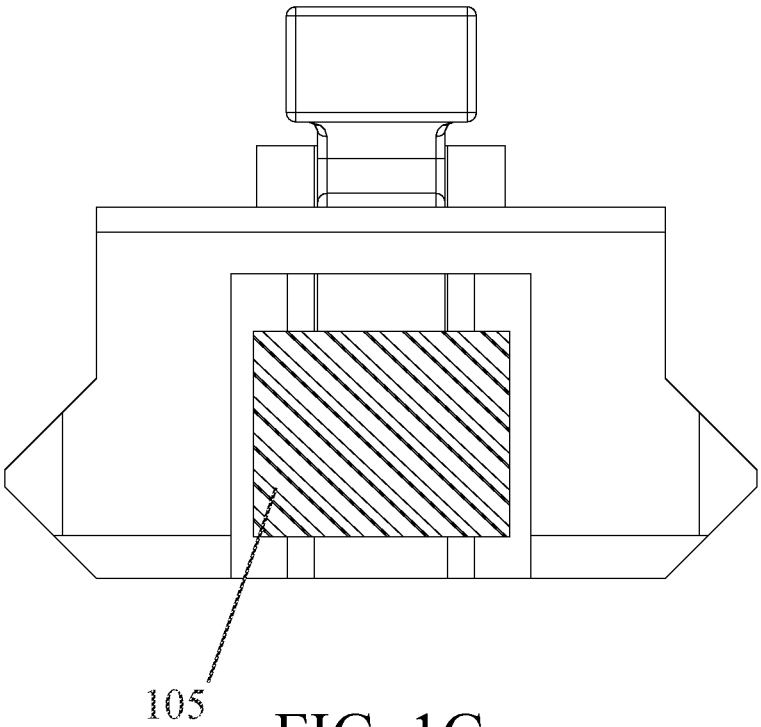
FIG. 1F is a rear end view of the mounting device of FIG. 1A.
Figure 1G:
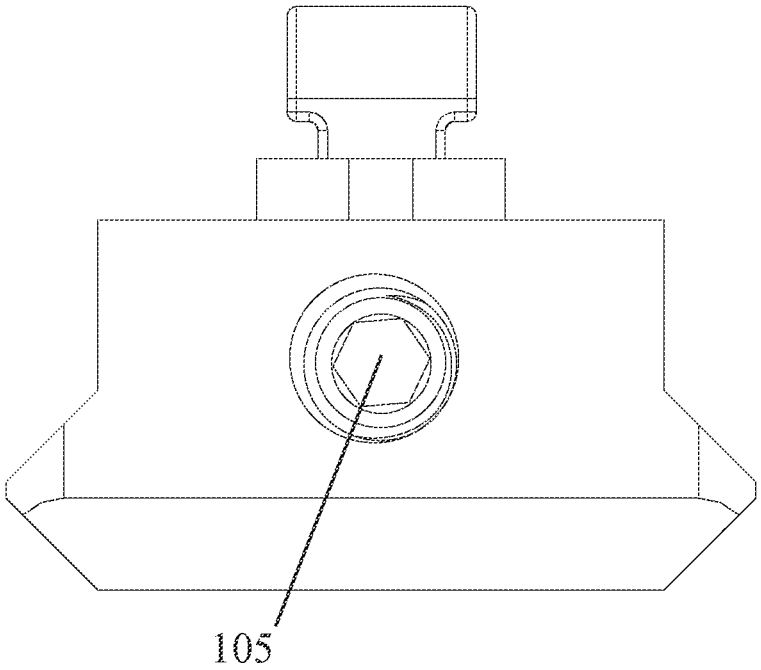
FIG. 1G is a front end view of the mounting device of FIG. 1A.

FIG. 1C is side view of the assembled mounting device 1 of FIG. 1A. FIG. 1D is top view of the assembled mounting device 1 of FIG. 1A. FIG. 1E is a bottom view of the assembled mounting device 1 of FIG. 1A. FIG. 1F is a rear end view of the assembled mounting device 1 of FIG. 1A. FIG. 1G is a front end view of the mounting device of FIG. 1A.

Figure 2A:
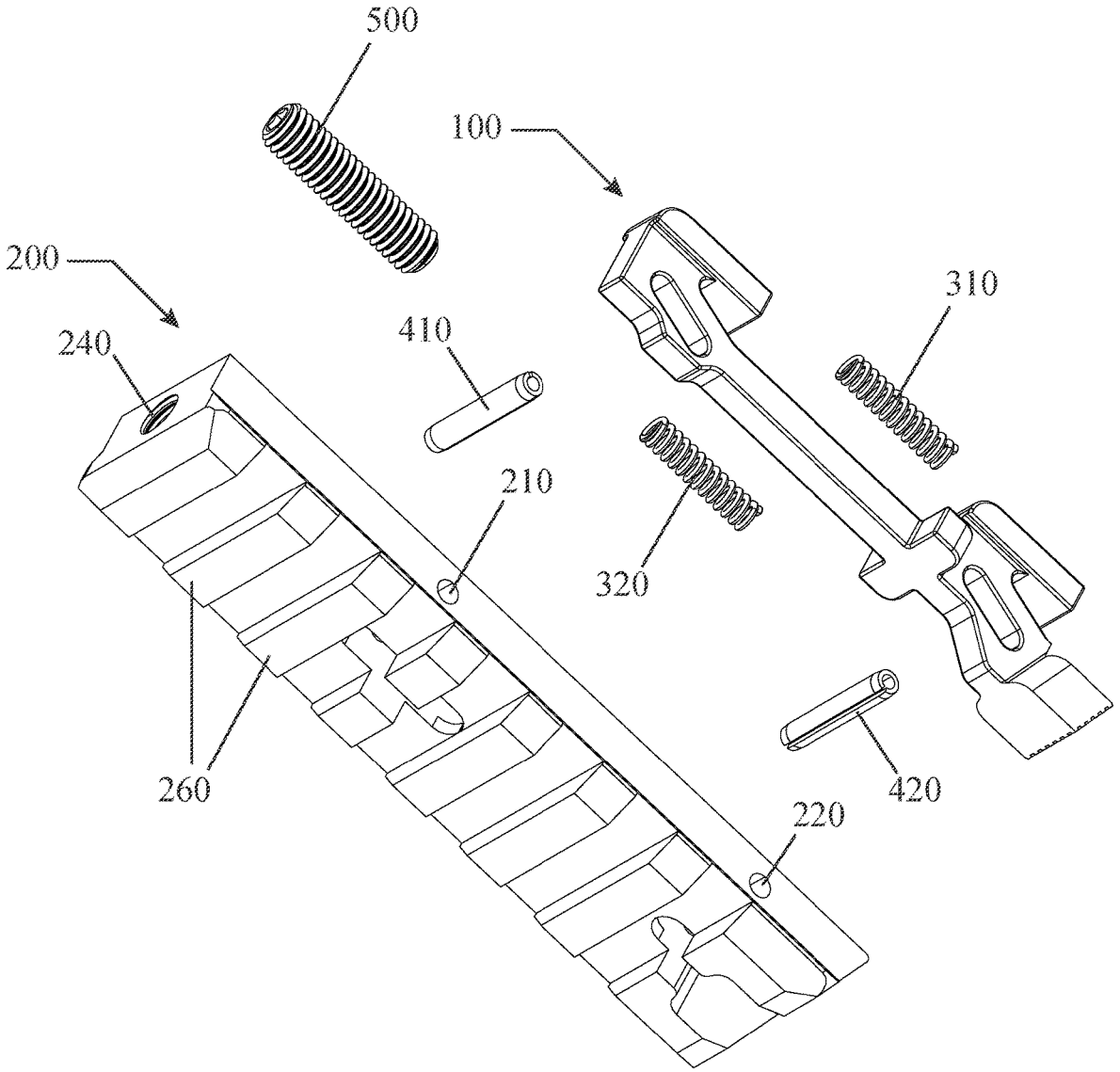
FIG. 2A is a lower exploded perspective view of the mounting device of FIG. 1A.
Figure 2B:
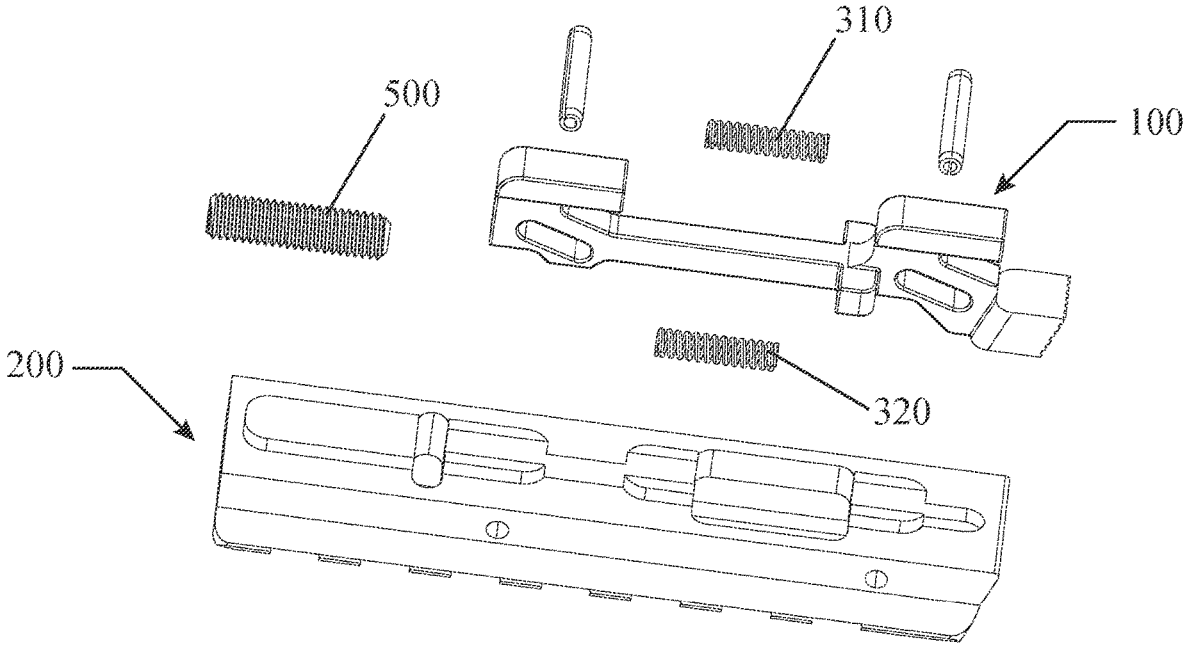
FIG. 2B is an upper exploded perspective view of the mounting device of FIG. 1A.
Figure 2C:
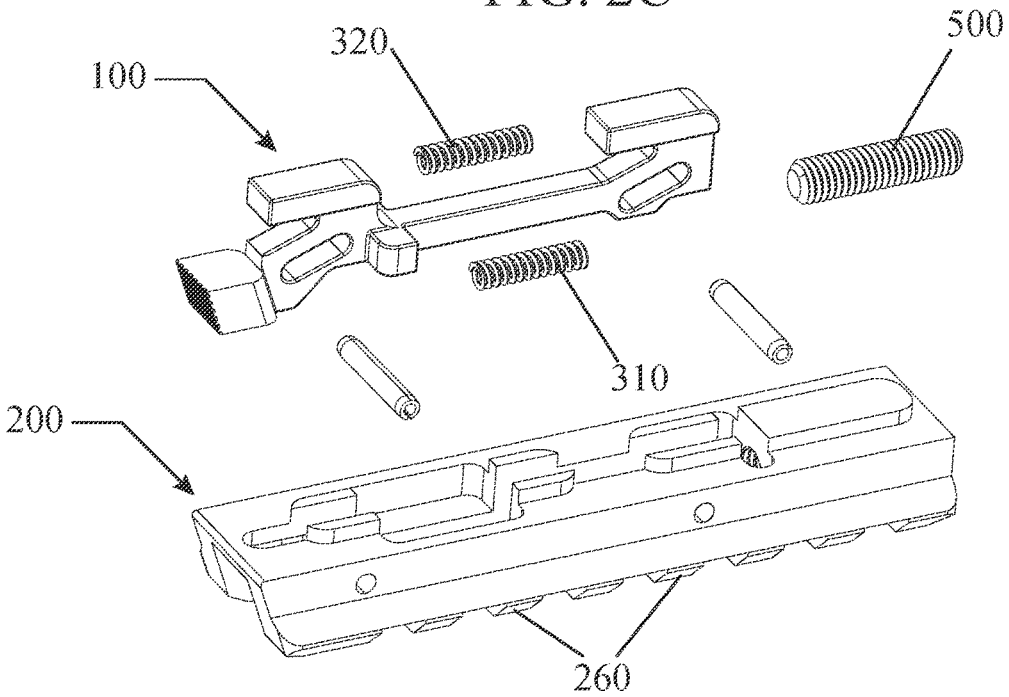
FIG. 2C is another an upper exploded perspective view of the mounting device of FIG. 2B

FIG. 2A is a lower exploded perspective view of the assembled mounting device 1 of FIG. 1A. FIG. 2B is an upper exploded perspective view of the assembled mounting device 1 of FIG. 1A. FIG. 2C is another an upper exploded perspective view of the assembled mounting device 1 of FIG. 2B.

Referring to FIGS. 2A-2C, the device 1 when unassembled, includes a single component double wedge member 100, a picatinny base mount 200, first horizontal coil spring 310, second horizontal coil spring 320, first pin spring 410, second pin spring 420 and torque screw 500.

Double Wedge Member 100

Figure 3D:
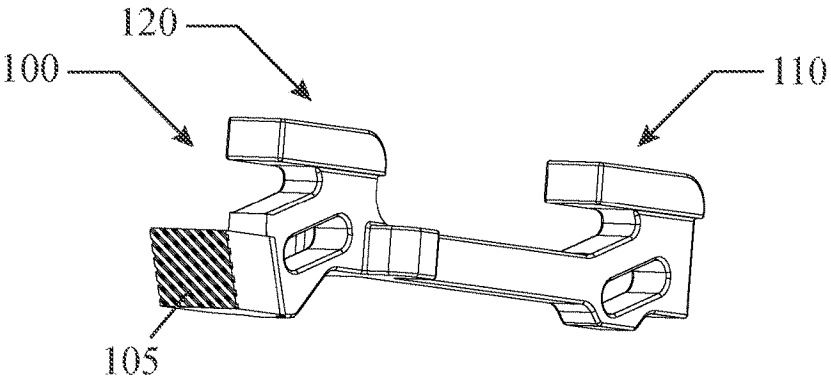
FIG. 3D is a rear side perspective view of the double wedge member of the preceding figures.
Figure 3C:
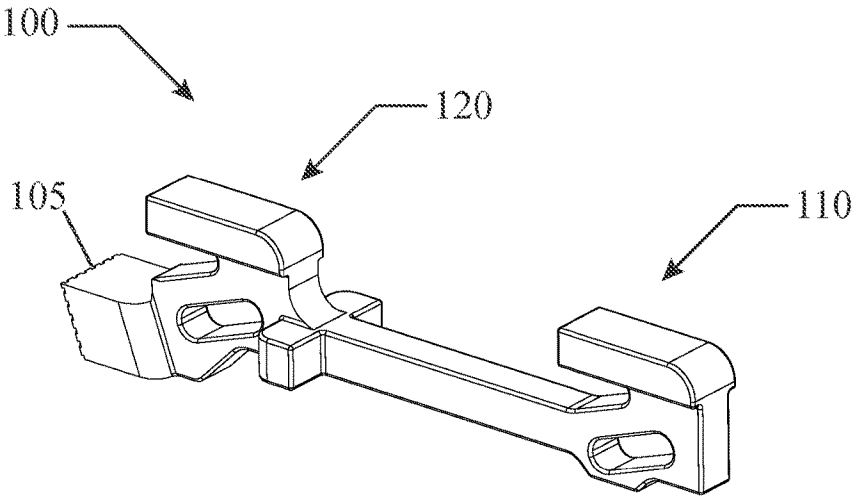
FIG. 3C is an upper left side perspective view of the double wedge member of the preceding figures.
Figure 3A:
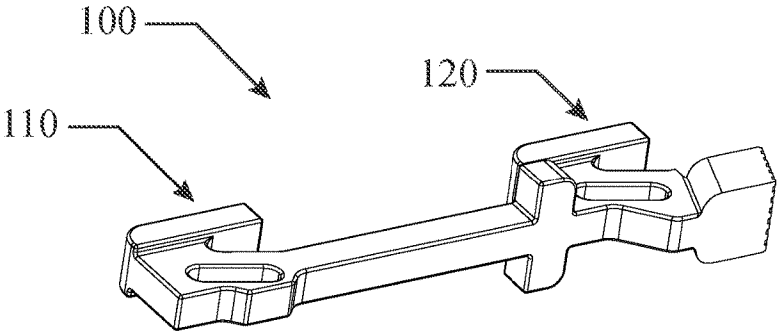
FIG. 3A is a lower front right side perspective view of the double wedge member of the preceding figures.
Figure 3B:
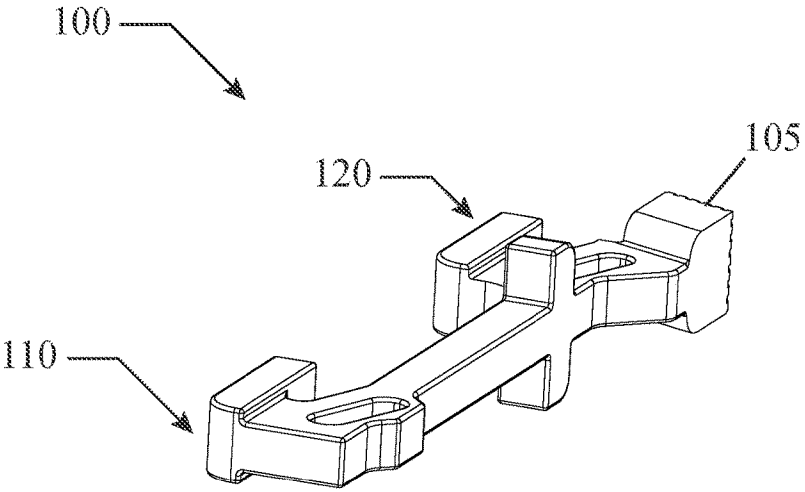
FIG. 3B is another lower front right side perspective view of the double wedge member of the preceding figures.

FIG. 3A is a lower front right side perspective view of the double wedge member 100 of the preceding figures. FIG. 3B is another lower front right side perspective view of the double wedge member 100 of the preceding figures.

FIG. 3C is an upper left side perspective view of the double wedge member 100 of the preceding figures.

FIG. 3D is a rear side perspective view of the double wedge member 100 of the preceding figures.

Figures 4A, 4B, 4C, 4D, 4E, 4F:
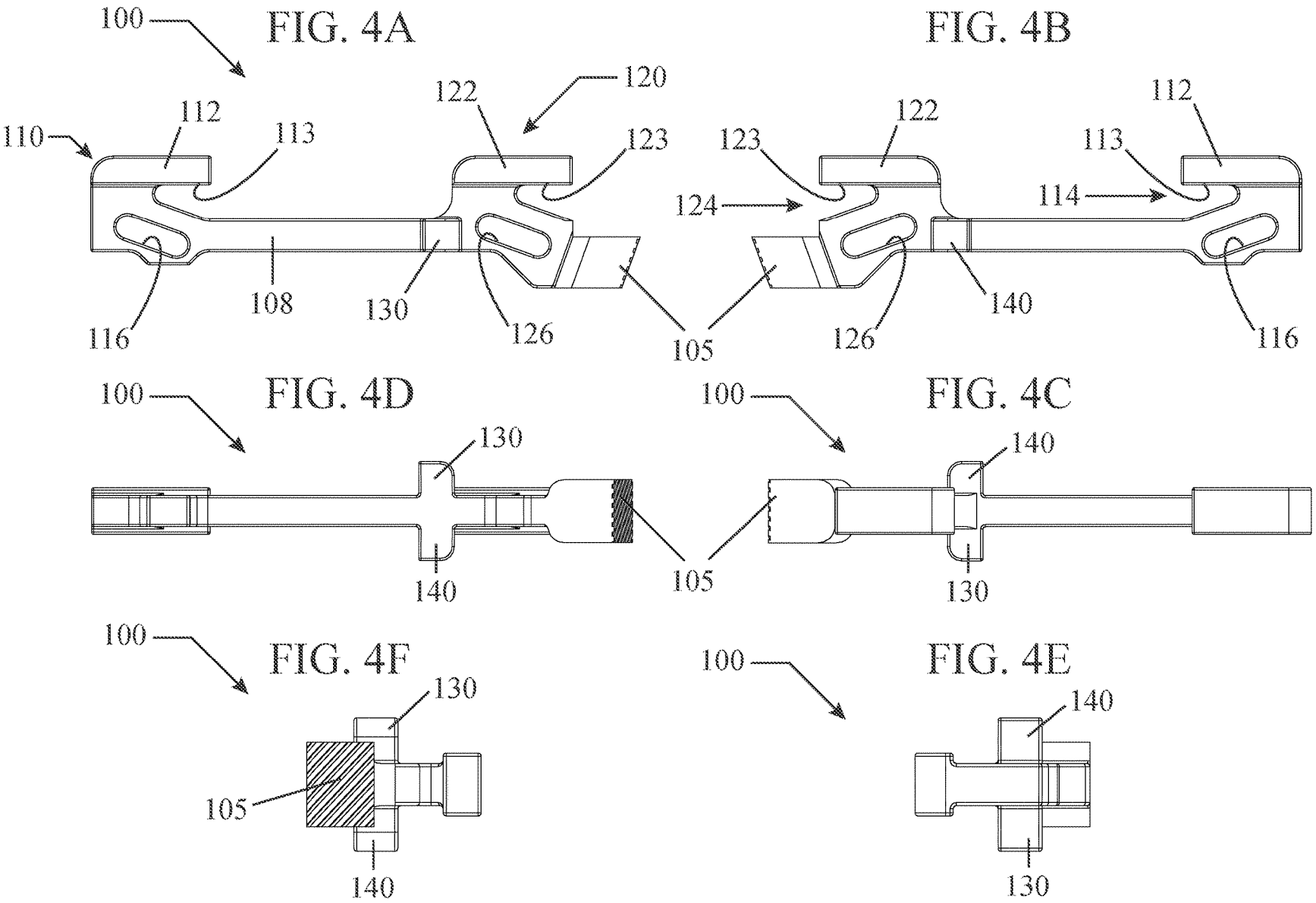
FIG. 4A is a right side view of the double wedge member of FIG. 3A.
FIG. 4B is a left side view of the double wedge member of FIG. 3A.
FIG. 4C is a top view of the double wedge member of FIG. 3A.
FIG. 4D is a bottom view of the double wedge member of FIG. 3A.
FIG. 4E is a front view of the double wedge member of FIG. 3A.
FIG. 4F is a rear view of the double wedge member of FIG. 3A.

FIG. 4A is a right side view of the double wedge member 100 of FIG. 3A.

FIG. 4B is a left side view of the double wedge member 100 of FIG. 3A.

FIG. 4C is a top view of the double wedge member 100 of FIG. 3A. FIG. 4D is a bottom view of the double wedge member 100 of FIG. 3A. FIG. 4E is a front view of the double wedge member 100 of FIG. 3A. FIG. 4F is a rear view of the double wedge member 100 of FIG. 3A.

Referring to FIGS. 3A-4C, the double wedge member 100 includes a long beam 108 having a first wedge 110 adjacent a front end, and a second wedge 120 adjacent to a rear end.

The first wedge 110 can include a first wedge leg (first locking lug) 112 with a flat overhang horizontal surface 113 and a wedge space 114 therebetween. A first angled elliptical slot 116 can be through the front end of the beam 105. The second wedge 120 can include a second wedge leg (second locking lug) 122 with a flat overhang horizontal surface 123 and a wedge space 124 therebetween. To one side of the wedge member 100 can be a sideways extending first side stem 130 adjacent to the rear end of the wedge member 100, and another opposite facing sideways extending second side stem 140 adjacent to the rear end of the wedge member 100.

The first and second angled elliptical slots 116, 126 can have an angle of approximately 20 degrees from a longitudinal horizontal plane of the long beam 105 of the wedge member 100.

Picatinny Base Mount 300

Figure 5A:
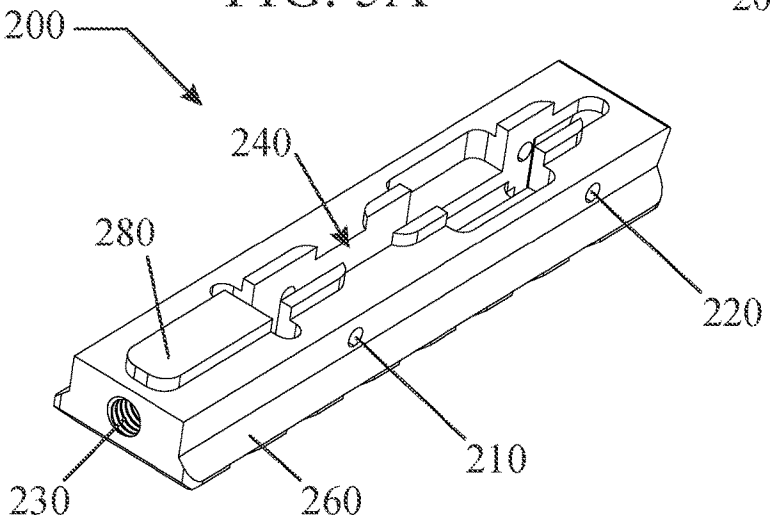
FIG. 5A is an upper front right perspective view of the picatinny base mount of FIGS. 1A-2C.
Figure 5D:
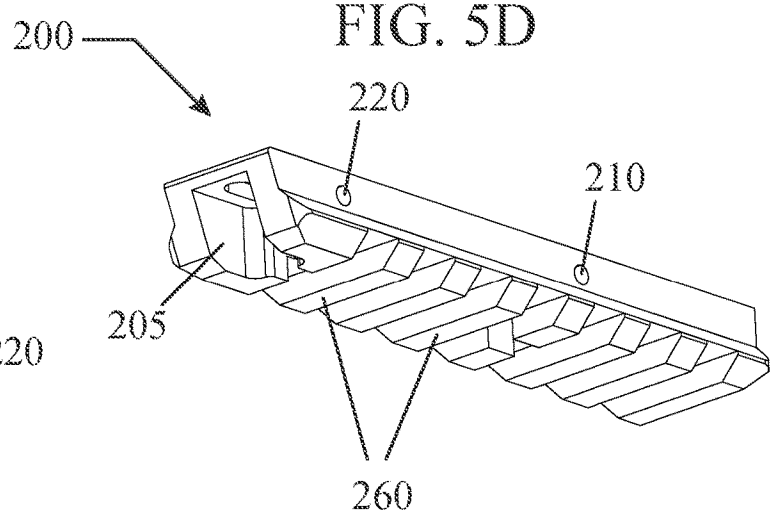
FIG. 5D is a lower rear right perspective view of the picatinny base mount of FIG. 5A.
Figure 5B:
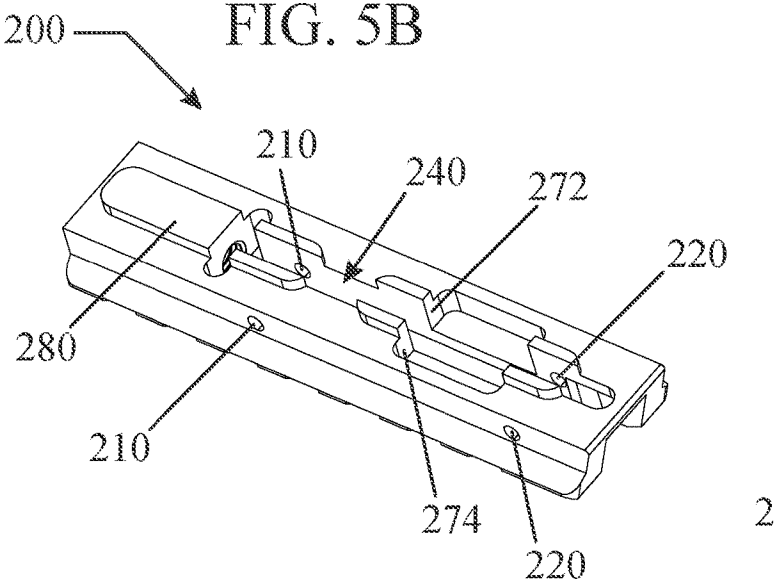
FIG. 5B is an upper rear perspective view of the picatinny base mount of FIG. 5A
Figure 5C:
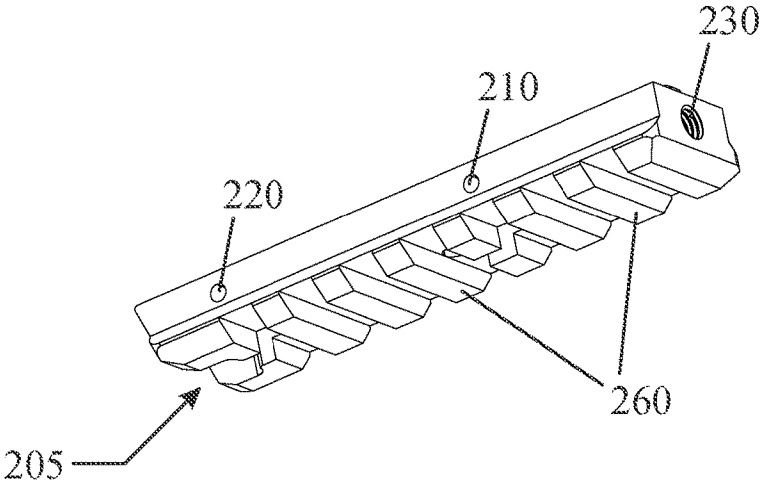
FIG. 5C is a lower front left perspective view of the picatinny base mount of FIG. 5A.

FIG. 5A is an upper front right perspective view of the picatinny base mount 200 of FIGS. 1A-2C. FIG. 5B is an upper rear perspective view of the picatinny base mount 200 of FIG. 5A. FIG. 5C is a lower front left perspective view of the picatinny base mount 200 of FIG. 5A. FIG. 5D is a lower rear right perspective view of the picatinny base mount 200 of FIG. 5A.

Figure 6D:
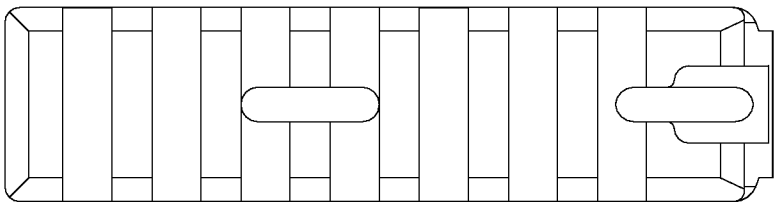
FIG. 6D is a bottom view of the picatinny base mount of FIG. 5A.
Figure 6C:
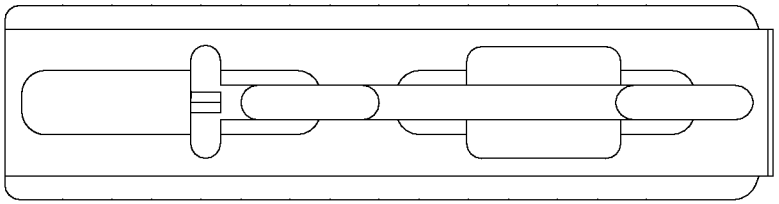
FIG. 6C is a top view of the picatinny base mount of FIG. 5A.
Figure 6F:
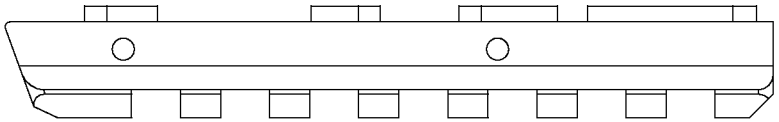
FIG. 6F is a left side view of the picatinny base mount of FIG. 5A.
Figure 6A:
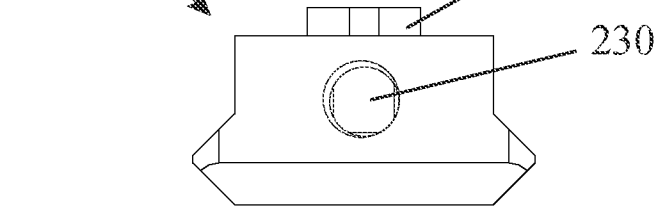
FIG. 6A is a front view of the picatinny base mount of FIG. 5A.
Figure 6B:
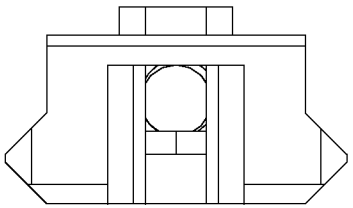
FIG. 6B is a rear view of the picatinny base mount of FIG. 5A.
Figure 6E:
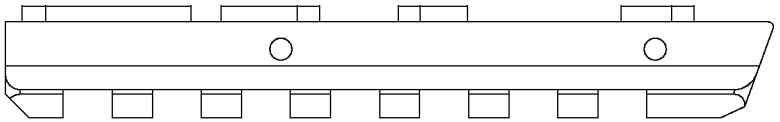
FIG. 6E is a right side view of the picatinny base mount of FIG. 5A.

FIG. 6A is a front view of the picatinny base mount 200 of FIG. 5A. FIG. 6B is a rear view of the picatinny base mount 200 of FIG. 5A. FIG. 6C is a top view of the picatinny base mount 200 of FIG. 5A. FIG. 6D is a bottom view of the picatinny base mount 200 of FIG. 5A. FIG. 6E is a right side view of the picatinny base mount 200 of FIG. 5A. FIG. 6F is a left side view of the picatinny base mount 200 of FIG. 5A.

Referring to FIGS. 5A-6F, the picatinny base mount 200 includes a generally rectangular configuration with a first through-hole 210 adjacent to a front end passing from one side to the other side, and a second through-hole 220 parallel to the first through-hole 210 adjacent a rear end passing from one side to the other side. The through-holes 210, 220 are for allowing the first pin spring 410 and the second pin spring 420, shown in FIGS. 2A-2C to be inserted therein.

The lower side of the picatinny base mount 200 can include parallel rows of picatinny rails 260. The upper side of the base mount 200 can include a longitudinal cavity 240 running lengthwise for allowing the long beam 108 of the double wedge member 100 to be positioned therein. Abutment walls 272, 274 can be positioned adjacent to cavities for supporting the first horizontal coil spring 310 and second horizontal coil spring 320, as further shown in FIG. 1D.

Bosses 280 on the upper side of the picatinny base mount 200 can keep the assembled device 1 shown in FIGS. 1B, 1C from moving side to side.

The operation of the assembled mounting device 1 will be described in reference to the sequence views of FIGS. 7A1 to 7AF.

Sequence Views 7A1-7F1

FIG. 7A1 is a side cross-sectional view of the assembled mounting device 1 detached from a multiple slot rail (mounting interface/platform) 610 on a firearm (not shown).

FIG. 7B1 shows the mounting device 1 of FIG. 7A1 with push button 105 depressed in the direction of arrow D (by a finger) causing the two wedge legs 112, 122 to extend below the assembly 1, ready to be positioned into a pair of slots on the rail 610.

FIG. 7C1 shows the mounting device 1 of FIG. 7B1 sitting flush on the mounting interface of the rail 610 with the wedge legs 112, 122 within the two slots (with button 105 still depressed).

FIG. 7D1 shows the mounting device 1 of FIG. 7C1 with the wedge legs 112, 122 moving in the direction of arrow X to locked positions, as the button 105 is being released.

FIG. 7E1 shows the mounting device 1 of FIG. 7C1 with a thinner wall thickness on the multiple slot rail (mounting interface) 610' on a firearm, with the wedge legs moving in the direction of arrow X to locked positions, as the button 105 is being released.

FIG. 7F1 is another view of FIGS. 7D1 and 7E1, using a secondary locking feature with a rear screw 500 torqued down to prevent the wedge legs 112, 122 from moving out of their locked positions.

FIG. 7A2 is a lower side perspective view of FIG. 7A1.
FIG. 7B2 is a lower side perspective view of FIG. 7B1.
FIG. 7C2 is a lower side perspective view of FIG. 7C1.
FIG. 7D2 is a lower side perspective view of FIG. 7D1.
FIG. 7E2 is a lower side perspective view of FIG. 7E1.
FIG. 7F2 is a lower side perspective view of FIG. 7F1.
FIG. 7A3 is a is a bottom view of FIG. 7A1.
FIG. 7B3 is a bottom view of FIG. 7B1.
FIG. 7C3 is a bottom view of FIG. 7C1.
FIG. 7D3 is a bottom view of FIG. 7D1.
FIG. 7E3 is a bottom view of FIG. 7E1.
FIG. 7F3 is a bottom view of FIG. 7F1.

FIGS. 7A1-7A3 shows the assembly 1 detached from the rail 620, and the first step which is to depress the knurled surface 105 of the wedge member 100, which has constant spring force with compression springs 310, 320.

FIGS. 7B1-7B3 shows the wedge assembly 1 with two cam arms (wedge legs 112, 122) angled away, caused by depressing the knurled surface 105. Also note the compression of the two compression springs 310, 320, which constantly push on the two legs (lugs) 112, 122 on the wedge assembly 1.

FIGS. 7C1-7C3 shows the entire device assembly 1 mated against the surface with the slot interface 610. Note, the assembly 1 can be mounted because the lugs are clearing the groove slots on the mounting interface surface 610. Note, the thumb is still pressing on the knurled button area 105 until the assembly is sitting flush on the mounting surface 610.

FIGS. 7D1-7D3 shows the wedge member 100 locked, which happens when the user lets go of the knurled surface 105, and the springs 310, 320 cam the entire wedge assembly 1 at an angle until it hits the inside surface of the mounting interface 610. The arrow X depicts the wedge moving in one direction. The constant spring pressure 310, 320 keeps the wedge member 100 locked. It would be important to note, that because the wedge member 100 moves at an acute angle, there is less likelihood that the linear recoil forces of a firearm would move the wedge out of its locked position.

FIGS. 7E1-7E3 shows the same exact view as FIGS. 7D1-7D23 with the only difference being a thinner wall thickness of the mounting interface 610'. This is important, as it depicts the necessity of the wedge member to travel at an angle so it can accommodate the various wall thicknesses, and self adjusts. Also note the difference of travel of the wedge, and different gaps in the slots on the wedge slots where the pins 410, 420 guide.

The elliptical slots 116, 126 control the angle of the wedge legs 112, 122 to clear multiple thickness rail interfaces 610, 610'. And the slots 116, 126 allow the wedge legs (lugs) 112, 122 to move at an angle until flush with an inside surface of the rail interface 610/610'.

FIGS. 7F1-7F3 shows the rear screw 500 torqued down. This is only a secondary locking function, to prevent the wedge member 1 from moving out of the locked position under severe positions, or when more force is applied to an object. For Example, if someone is mounting a flashlight to the rail 610, there is little stress applied. The device 1 can easily be removed by pushing the button knurled surface 105 and the assembly 1 removed, and attached to another firearm, and the like If the device assembly 1 was used to mount a bipod, forward grip, and the like, the user can torque the screw 500 down as a positive locking mate. If the user doesn't plan on removing the device to attach to another firearm, they can also torque down the screw 500. An optional torque wrench can be used if needed. Locking washers, and the like can also be used as needed.

FIG. 8 is a perspective view of the assembled mounting device 1 locked on a multiple slot rail (mounting interface) 610 on a firearm 600.

While the above embodiments show and describe using two wedges with two legs, the wedge member can include three wedges or more, each with wedge legs. While the above embodiments show and describe using two horizontal coil springs, the wedge assembly can be modified to be used with one horizontal coil spring.

The term "approximately" is similar to the term "about" and can be +/−10% of the amount referenced. Additionally, preferred amounts and ranges can include the amounts and ranges referenced without the prefix of being approximately.

Although specific advantages have been enumerated above, various embodiments may include some, none, or all of the enumerated advantages.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A mounting device for a multiple slot interface on a firearm, the device comprising:

a double wedge member having an upper attachment member, and a lower side with two wedge legs; and a picatinny base mount with an upper side with an elongated slot and lower side with picatinny rails, wherein the upper attachment member of the double wedge member attaches to the picatinny base mount through the elongated slot, and the two wedge legs of the double wedge member attach to a pair of slots in the multiple slot interface on the firearm.

2. The mounting device of claim 1, wherein the double wedge member includes:

a horizontal beam member having a front end and a rear end, and a first wedge leg adjacent the front end spaced below the beam extending in one direction, and a second wedge leg adjacent the rear end spaced below the beam extending in the one direction.

3. The mounting device of claim 2, wherein the double wedge member further comprises:

a knurled surface on the rear end forming a button surface;

a first angled slot in the beam above the first wedge leg; and a second angled slot in the beam above the second wedge leg.

4. The mounting device of claim 3, wherein the picatinny base mount further comprises:

a pair of longitudinal channels; and a pair of coil springs in the pair of channels, wherein pushing against the button surface on the rear end of the wedge member causes the first wedge leg and the second wedge leg to extend below the mounting device, and releasing the button surface on the rear end of the wedge member causes the first wedge leg and the second wedge leg to move sideways in one horizontal direction, and retract into the mounting device, until the mounting device become fixed against an exterior surface portion of the multiple slot interface on the firearm.

5. The mounting device of claim 3, wherein the picatinny base mount further comprises:

a pair of spring pins each passing through the first angled slot and the second angled slot, for guiding the direction of the wedge member as the button surface is depressed and released.

6. The mounting device of claim 4, wherein the picatinny base mount further comprises:

a pair of spring pins each passing through the first angled slot and the second angled slot, for guiding the direction of the wedge member as the button surface is depressed and released.

7. The mounting device of claim 1, wherein the picatinny base mount further comprises:

a threaded socket; and a screw member for being screwed into the threaded socket, wherein the screw member when tightened down in to the threaded socket locks the two wedge legs of the double wedged member in a locked position against an exterior surface portion of the multiple slot interface on the firearm, to prevent the mounting device from being dislodged from the multiple slot interface on the firearm.

8. The mounting device of claim 4, wherein the picatinny base mount further comprises:

a threaded socket; and a screw member for being screwed into the threaded socket, wherein the screw member when tightened down in to the threaded socket locks the two wedge legs of the double wedged member in a locked position against the exterior surface portion of the multiple slot interface on the firearm, to prevent the mounting device from being dislodged from the multiple slot interface on the firearm.

9. The mounting device of claim 6, wherein the picatinny base mount further comprises:

a threaded socket; and a screw member for being screwed into the threaded socket, wherein the screw member when tightened down in to the threaded socket locks the two wedge legs of the double wedged member in a locked position against an exterior surface portion of the multiple slot interface on the firearm, to prevent the mounting device from being dislodged from the multiple slot interface on the firearm.

10. The mounting device of claim 3, wherein the first angled slot and the second angled slot include an angle of approximately 20 degrees.

11. The mounting device of claim 5, wherein the first angled slot and the second angled slot include an angle of approximately 20 degrees.

12. The mounting device of claim 6, wherein the first angled slot and the second angled slot include an angle of approximately 20 degrees.

13. A mounting assembly for a multiple slot interface on a firearm, the assembly comprising:

a wedge member having an upper attachment member, and a lower side with a plurality of wedge legs; and a picatinny base mount with an upper side with an elongated slot and lower side with picatinny rails, wherein the upper attachment member of the wedge member attaches to the picatinny base mount through the elongated slot, and the plurality of wedges of the wedge member attach to a pair of slots in the multiple slot interface on the firearm.

14. The mounting assembly of claim 13, wherein the wedge member includes:

a horizontal beam member having a front end and a rear end, and a first wedge leg adjacent the front end spaced below the beam extending in one direction, and a second wedge leg adjacent the rear end spaced below the beam extending in the one direction.

15. The mounting assembly of claim 14, wherein the wedge member further comprises:

a depressable surface on the rear end forming a button surface;

a first angled slot in the beam above the first wedge leg; and a second angled slot in the beam above the second wedge leg.

16. The mounting assembly of claim 13, wherein the picatinny base mount further comprises:

a pair of longitudinal channels; and a pair of coil springs in the pair of channels, wherein pushing against the button surface on the rear end of the wedge member causes the first wedge leg and the second wedge leg to extend below the mounting device, and releasing the button surface on the rear end of the wedge member causes the first wedge leg and the second wedge leg to move sideways in one horizontal direction, and retract into the mounting device, until the mounting device become fixed against an exterior surface portion of the multiple slot interface on the firearm.

17. The mounting assembly of claim 15, wherein the picatinny base mount further comprises:

a pair of spring pins each passing through the first angled slot and the second angled slot, for guiding the direction of the wedge member as the button surface is depressed and released.

18. The mounting assembly of claim 15, wherein the first angled slot and the second angled slot include an angle of approximately 20 degrees.

19. The mounting assembly of claim 13, wherein the picatinny base mount further comprises:

a threaded socket; and a screw member for being screwed into the threaded socket, wherein the screw member when tightened down into the threaded socket locks the wedge legs of the double wedged member in a locked position against an exterior surface portion of the multiple slot interface on the firearm, to prevent the mounting assembly from being dislodged from the multiple slot interface on the firearm.

* * * * *